US012501998B2

(12) United States Patent
Walker

(10) Patent No.: US 12,501,998 B2
(45) Date of Patent: Dec. 23, 2025

(54) RETAINER FOR MERCHANDISE DISPENSING SYSTEM

(71) Applicant: Fasteners for Retail, Inc., Twinsburg, OH (US)

(72) Inventor: William H. Walker, Fairlawn, OH (US)

(73) Assignee: Fasteners for Retail, Inc., Twinsburg, OH (US)

( * ) Notice: Subject to any disclaimer, the term of this patent is extended or adjusted under 35 U.S.C. 154(b) by 0 days.

(21) Appl. No.: 18/680,227

(22) Filed: May 31, 2024

(65) Prior Publication Data

US 2024/0398114 A1 Dec. 5, 2024

Related U.S. Application Data

(60) Provisional application No. 63/505,621, filed on Jun. 1, 2023.

(51) Int. Cl.

| | |
|---|---|
| ***A47B 57/58*** | (2006.01) |
| ***A47B 96/04*** | (2006.01) |
| ***A47F 5/00*** | (2006.01) |

(52) U.S. Cl.

CPC ..... *A47B 57/585* (2013.01); *A47B 96/04* (2013.01); *A47F 5/005* (2013.01)

(58) Field of Classification Search

CPC ..... A47F 5/005; A47F 5/0068; A47B 57/585; A47B 96/04; A47B 88/975; A47B 57/586; A47B 57/588; A47B 57/583

USPC ..... 211/184, 119.003, 59.2

See application file for complete search history.

(56) References Cited

U.S. PATENT DOCUMENTS

| | | | | | |
|---|---|---|---|---|---|
| 431,373 | A * | 7/1890 | Mendenhall | A47B 65/15 | 211/43 |
| 1,995,335 | A * | 3/1935 | Wilke | A47F 5/005 | 220/543 |
| 2,623,641 | A * | 12/1952 | Shield | A47F 1/12 | 211/175 |
| 2,933,195 | A * | 4/1960 | Radek | A47B 57/58 | 248/220.42 |
| 3,750,894 | A * | 8/1973 | Jensen | A47F 5/14 | 24/336 |
| 4,190,166 | A * | 2/1980 | Allsop | A63C 11/22 | 211/70.5 |
| 4,331,243 | A * | 5/1982 | Doll | A47F 1/121 | 211/184 |
| 4,383,614 | A * | 5/1983 | Miller | B65G 1/023 | 211/183 |
| 4,693,382 | A * | 9/1987 | Galen | B60R 7/06 | 211/184 |
| 5,024,336 | A * | 6/1991 | Spamer | F16B 12/10 | 211/153 |
| 5,199,584 | A * | 4/1993 | Fowler | A47F 5/0043 | 211/184 |

(Continued)

*Primary Examiner* — Jennifer E. Novosad

(74) *Attorney, Agent, or Firm* — Honigman LLP; Andrew J. Boes

(57) ABSTRACT

A merchandise system for a retail shelf includes a front rail defining a channel, a retainer disposed parallel to and spaced apart from the front rail, and a first divider. The first divider has a first end and second end disposed on an opposite side of the first divider than the first end. The first end is configured to selectively engage the channel of the front rail and the second end is configured to selectively engage the retainer.

15 Claims, 10 Drawing Sheets

(56) References Cited

U.S. PATENT DOCUMENTS 5,269,600 A * 12/1993 Arreola ..... A47B 88/90 312/348.3
5,458,248 A * 10/1995 Alain ..... A47B 96/021 211/175
5,520,316 A * 5/1996 Chen ..... B60R 7/02 224/567
5,806,690 A * 9/1998 Johnson ..... A47F 1/126 211/59.3
5,884,782 A * 3/1999 Dembicks ..... B25H 3/06 211/175
5,971,173 A * 10/1999 Valiulis ..... A47F 5/005 211/184
6,389,991 B1 * 5/2002 Morrisson ..... A47B 57/585 211/184
6,497,326 B1 * 12/2002 Osawa ..... A47F 1/12 414/276
6,622,874 B1 * 9/2003 Hawkinson ..... A47F 1/126 211/59.3
6,886,699 B2 * 5/2005 Johnson ..... A47F 1/126 211/59.3
8,915,381 B2 * 12/2014 Brozak ..... A47F 7/0021 206/390
9,016,482 B2 * 4/2015 Kim ..... A47F 1/126 211/59.2
9,532,662 B2 * 1/2017 Desmond ..... G09F 3/204
9,565,952 B1 * 2/2017 Luberto ..... A47F 1/126
9,642,475 B2 * 5/2017 Vogler ..... A47F 5/0846
9,782,017 B1 * 10/2017 Luberto ..... A47F 1/125
10,178,909 B2 * 1/2019 Hardy ..... A47F 7/28
10,413,090 B2 * 9/2019 Hardy ..... A47F 5/0025
11,160,392 B2 * 11/2021 Ewing ..... A47F 1/126
2001/0002659 A1 * 6/2001 Bada ..... A47F 5/005 211/184
2002/0170866 A1 * 11/2002 Johnson ..... A47F 1/126 211/59.3
2003/0024889 A1 * 2/2003 Dumontet ..... A47F 1/125 211/59.3
2004/0004047 A1 * 1/2004 Nagel ..... A47F 1/126 211/59.3
2007/0138114 A1 * 6/2007 Dumontet ..... A47F 1/126 211/59.3
2007/0256992 A1 * 11/2007 Olson ..... A47F 5/005 211/59.3
2008/0156752 A1 * 7/2008 Bryson ..... A47F 1/126 211/59.3
2024/0398114 A1 * 12/2024 Walker ..... A47B 57/585

* cited by examiner

RETAINER FOR MERCHANDISE DISPENSING SYSTEM

CROSS-REFERENCE TO RELATED APPLICATIONS

This application claims priority under 35 U.S.C. § 119 (e) to U.S. Provisional Application 63/505,621, filed on Jun. 1, 2023. The disclosure of this prior application is considered part of the disclosure of this application and is hereby incorporated by reference in its entirety.

FIELD

The present disclosure relates generally to a retainer for a merchandise dispensing system.

BACKGROUND

This section provides background information related to the present disclosure and is not necessarily prior art.

In self-service retail establishments, such as drug stores, grocery stores and the like, articles are usually displayed for sale on racks consisting of vertically spaced shelves on which the articles are arranged in rows. These shelves may be provided with various dispensing systems configured to maintain alignment of the articles in the respective rows and to bias the articles towards a front edge of the shelf to maintain a front-facing display of the articles. For example, dispensing systems including a plurality of adjacent dividers, whereby a space between adjacent ones of the dividers defines a single row for receiving the articles. Optionally, the dividers may be used in connection with gravity-fed shelves or with a biasing element, such as a pusher for biasing the articles towards a front edge of the shelf. The front portions of these dispensing systems are typically affixed to a front rail of the shelf, while a rear portion of the display system is not attached to the shelf. Thus, the rear portions of the dispensing systems may have a tendency to flex or splay relative to adjacent ones of the dispensing systems, which can result in the articles becoming misaligned or binding on the track. Accordingly, a mechanism for easily retaining the rear of the system to limit lateral movement would greatly improve the stability of the system.

SUMMARY

One aspect of the disclosure provides a merchandise system for a retail shelf includes a front rail defining a channel, a retainer disposed parallel to and spaced apart from the front rail, and a first divider. The first divider has a first end and second end disposed on an opposite side of the first divider than the first end. The first end is configured to selectively engage the channel of the front rail and the second end is configured to selectively engage the retainer.

Implementations of the disclosure may include one or more of the following optional features. In some implementations, the retainer includes a wing and a rib, the wing and the rib cooperating to form a slot for receiving a portion of the first divider. In these implementations, the first divider may include a base and a sidewall extending from the base, the sidewall received within the slot of the retainer. In some examples, the first divider extends between and connects the front rail and the retainer.

In some implementations, the retail shelf further includes a second divider parallel to and spaced away from the first divider and having a first end a second end disposed on an opposite side of the second divider than the first end. Here, the first end of the second divider is configured to selectively engage the channel of the front rail and the second end of the second divider is configured to selectively engage the retainer. In these implementations, the retainer and the front rail may cooperate to maintain the alignment between the first divider and the second divider. The retainer may include a main body extending between a first end and a second end, the main body separating the first divider from the second divider. In these implementations, the retainer may further include a first wing and a first rib disposed on the first end of the main body and a second wing and a second rib disposed on the second end of the main body. The first wing and the first rib may cooperate to form a first engagement surface and a first slot sized to receive a portion of the first divider, and the second wing and the second rib may cooperate to form a second engagement surface and a second slot sized to receive a portion of the second divider. Additionally or alternatively, the first rib and the second rib may be inset from the first wing and the second wing along the main body. Optionally, the first rib may be spaced away from the first wing by a first slot, and the second rib may be spaced away from the second wing by a second slot.

Another aspect of the disclosure provides a merchandise system for a retail shelf includes a front rail, a retainer extending parallel to and spaced apart from the front rail, and a first divider. The retainer is configured to engage one or more dividers. The first divider has a first end and second end disposed on an opposite side of the first divider than the first end. The first end is configured to selectively engage the front rail and the second end is configured to selectively engage the retainer.

Implementations of this aspect of the disclosure may include one or more of the following optional features. In some implementations, a length of the retainer corresponds to a length of the front rail. In some examples, the retainer includes a plurality of teeth and a plurality of cutouts, each adjacent tooth in the plurality of teeth separated by a cutout of a plurality of cutouts. In these examples, a cutout of the plurality of cutouts may receive a portion of the first divider. Here, the portion of the first divider may be disposed between a first tooth and an adjacent second tooth of the plurality of teeth. Additionally or alternatively, the first divider may include a base and a sidewall extending from the base, the sidewall received within a cutout of the retainer.

In some implementations, the first divider extends between and connects the front rail and the retainer. In some examples, the retail shelf further includes a second divider parallel to and spaced away from the first divider and having a first end a second end disposed on an opposite side of the second divider than the first end, the first end of the second divider configured to selectively engage the front rail and the second end of the second divider configured to selectively engage the retainer. In these examples, the retainer and the front rail may cooperate to maintain the alignment between the first divider and the second divider. Here, the retainer may include a main body extending between a first end and a second end, and a plurality of teeth extending in series from the first end to the second end of the main body.

This section provides a general summary of the disclosure, and is not a comprehensive disclosure of its full scope or all of its features.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Figure 1A:
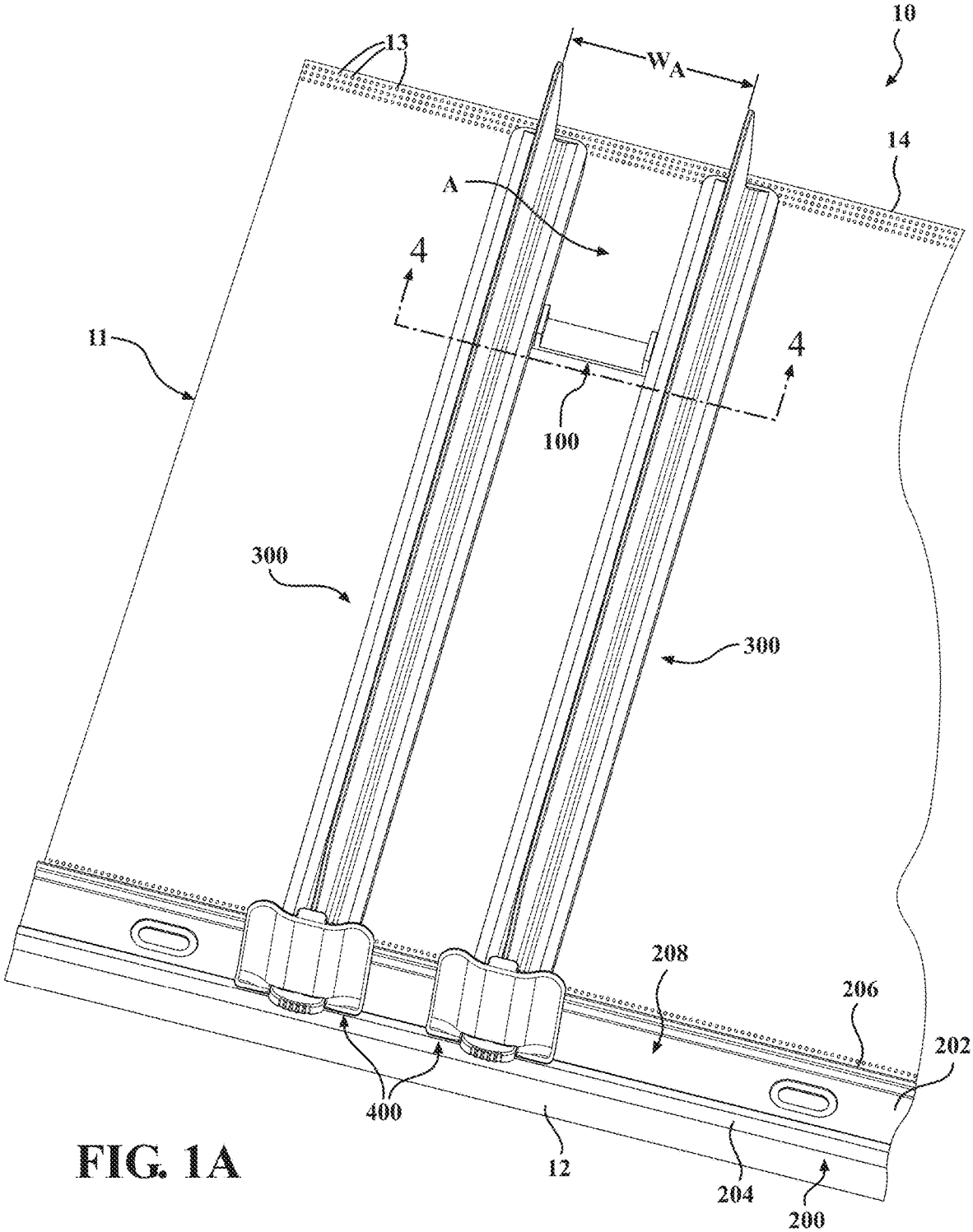
FIG. 1A is a top perspective view of a merchandise system for a retail shelf or other surface according to an example of the present disclosure.
Figure 1B:
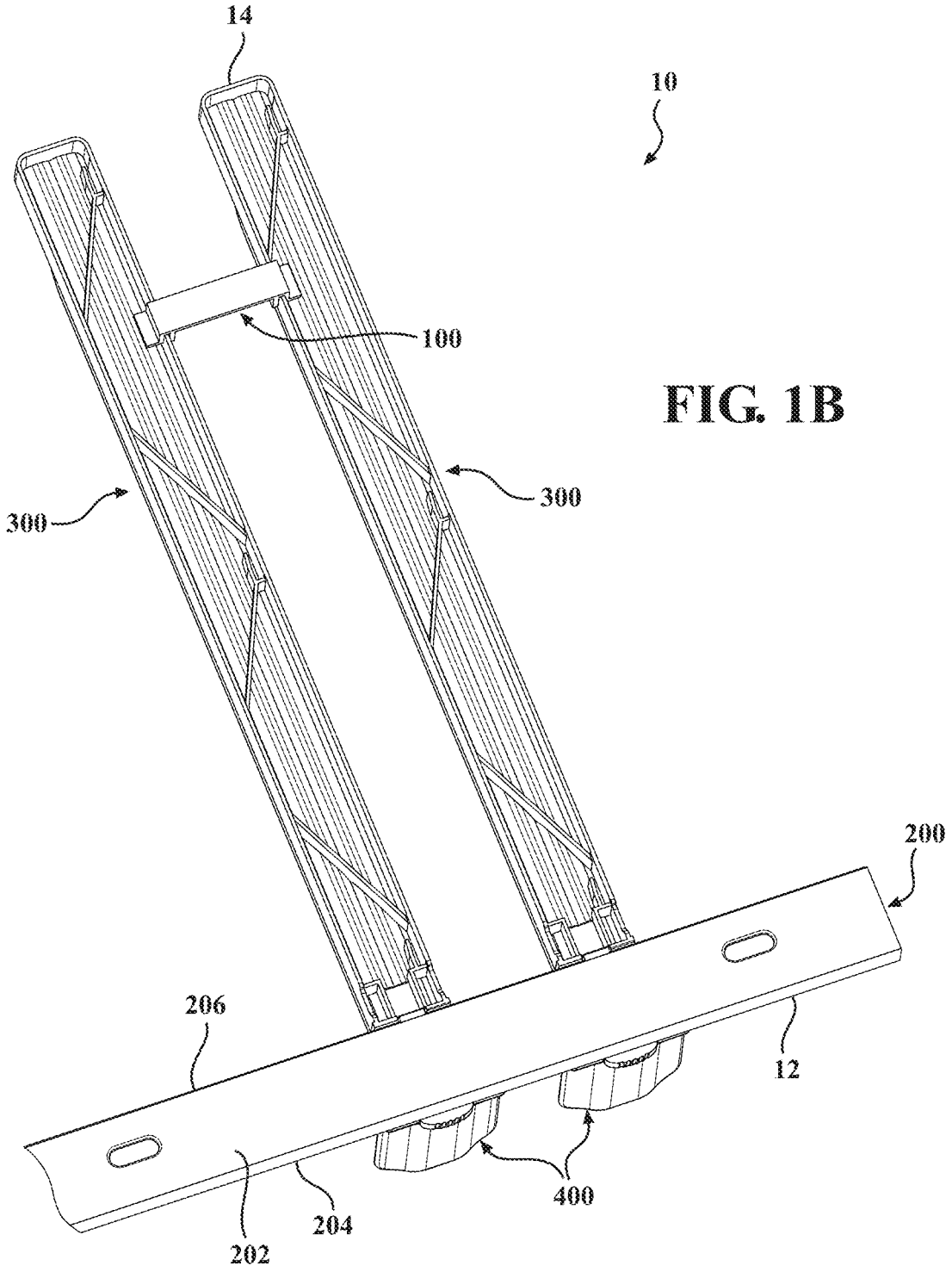
FIG. 1B is a bottom perspective view of the merchandise system of FIG. 1A.
Figure 2:
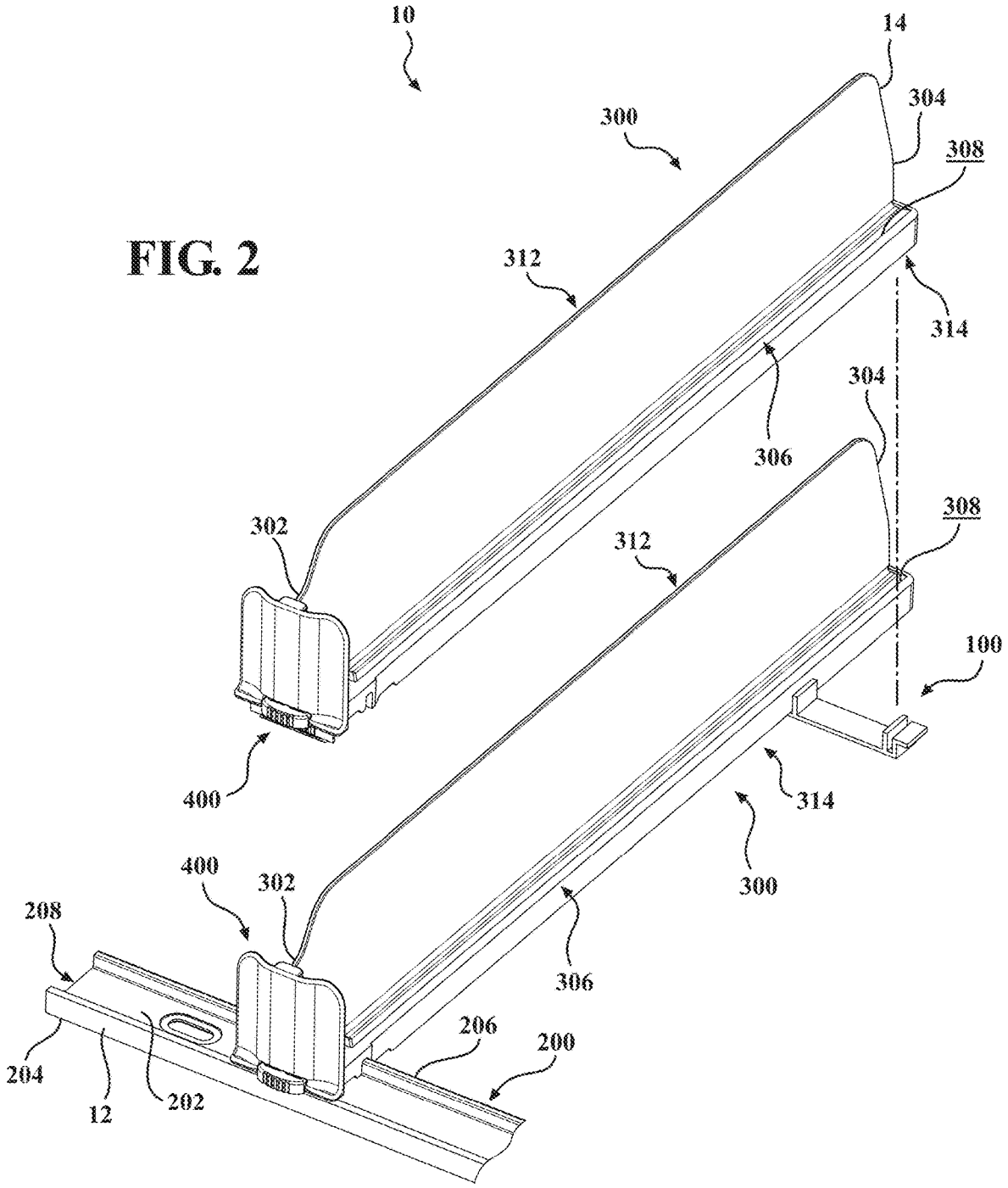
FIG. 2 is a partial exploded top perspective view of the merchandise system of FIG. 1A.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

Referring to FIGS. 1-4, a merchandise system or merchandising system 10 is generally shown. The merchandising system 10 may be installed on a top surface of a shelf 11, or other suitable base surface. The shelf 11 may be located in a store or other suitable location where consumers are able to purchase merchandise. As shown in FIGS. 1A and 1B, the merchandising system 10 extends from a front edge 12 to an opposite rear edge 14. As discussed throughout, the direction from the front edge 12 to the rear edge 14 defines a longitudinal direction while the direction parallel to the front edge 12 and the rear edge 14 defines a lateral direction. In some implementations, the shelf 11 may include apertures 13 extending through a thickness of the shelf 11 and arranged in series adjacent to each of the front edge 12 and the rear edge 14 of the merchandising system 10. Portions of the merchandising system 10 may be secured to the shelf 11 via fasteners engaging with the apertures 13. The merchandising system 10 may be secured to the shelf 11 in any suitable manner, and the merchandising system 10 may be selectively detached from the shelf 11 and moved, for example, to another shelf or other surface.

The merchandising system 10 includes a retainer 100, a front rail 200, one or more dividers 300, and one or more stop lenses 400. In the illustrated example, the merchandising system 10 includes the retainer 100, the front rail 200, and a pair of the dividers 300 extending longitudinally between the retainer 100 and the front rail 200. When the merchandising system 10 is installed on a shelf 11, any suitable merchandise may be positioned within a product receiving area A disposed between adjacent ones of the dividers 300, and behind a stop lens 400. The dividers 300 are selectively positionable along the front rail 200 and extend between the front rail 200 and the retainer 100. The dividers 300 are configured to receive the stop lenses 400 at a first end of the product receiving area A, whereby respective ones of the stop lenses 400 attach to the first end 302 of a corresponding divider 300 and extend at least partially into the product receiving area A to prevent the merchandise from falling from the shelf. Advantageously, when assembled, the retainer 100 is operable to further secure adjacent dividers 300 to one another, thereby preventing the second ends of the adjacent dividers 300 from drifting laterally out of alignment (i.e., perpendicular to the front rail 200). Any of the retainer 100, the front rail 200, the divider 300, and the stop lens 400, or portions thereof, may be formed of a known suitable plastic, such as a thermoplastic extrusion, or metal, such as an aluminum extrusion.

the front rail 200 includes a base 202, a front wall 204 extending from a first side of the base 202, and a rear wall 206 extending from the base 202 and spaced apart from the front wall 204 by a channel 208. When the front rail 200 is installed on the shelf 11, the front wall 204 is closer to the front edge 12 of the merchandising system 10 (i.e., the customer's vantage point) than the rear wall 206. The base 202, the front wall 204, and the rear wall 206 cooperate to form the channel 208 that provides a sliding interface for the one or more dividers 300.

Figure 3A:
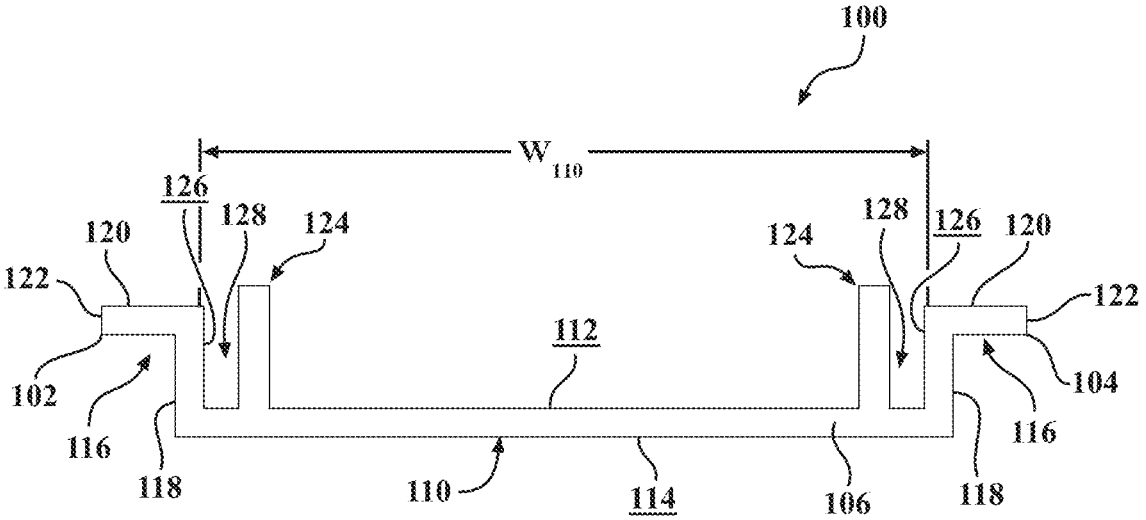
FIG. 3A is a front view of a retainer of the merchandise system of FIG. 1A.
Figure 3B:
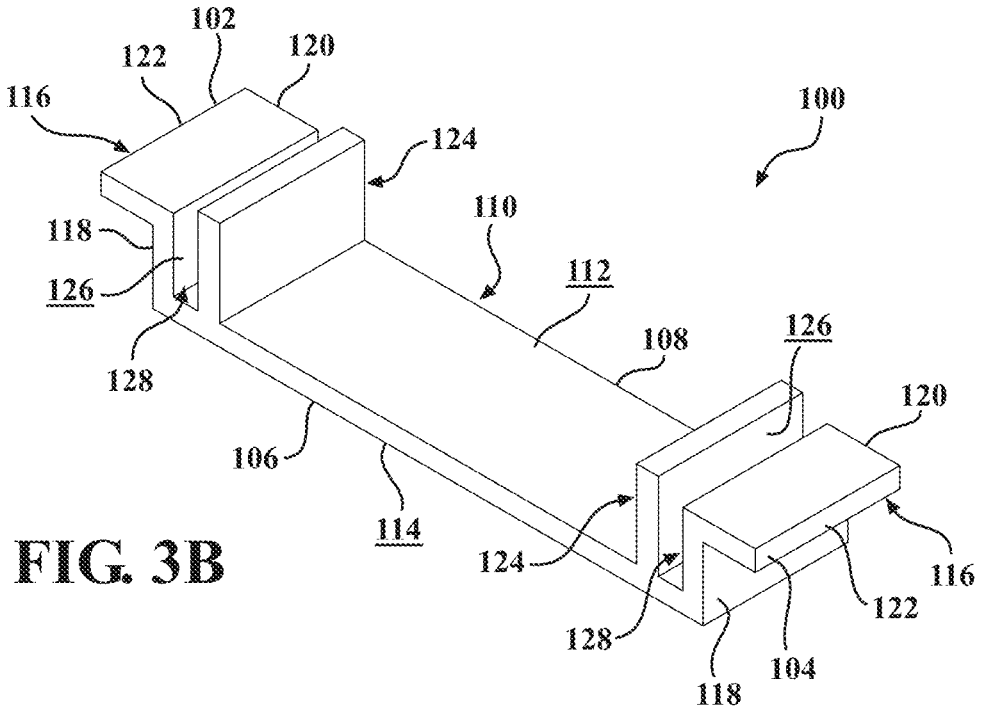
FIG. 3B is a top perspective view of the retainer of FIG. 3A.

Referring to FIGS. 3A and 3B, the retainer 100 is defined by a first side 102, a second side 104 disposed on an opposite side of the retainer 100 than the first side 102, a front end 106, and a back end 108 disposed on an opposite side of the retainer 100 than the front end 106. The retainer 100 further includes a main body 110 extending between the first side 102 and the second side 104 and between the front end 106 and the back end 108, The main body 110 is defined by a top surface 112 and a bottom surface 114 disposed on an opposite side of the main body 110 than the top surface 112. A width $W_{110}$ of the main body 110 is defined by a pair of parallel wings 116 disposed on respective sides 102, 104 of the retainer 100. Each of the wings 116 extends from the top surface 112 of the main body 110 and between the front end 106 and the back end 108 of the retainer 100. Each wing 116 may be defined by a first portion 118 extending perpendicularly from the top surface 112 from a first end disposed on the top surface 112 of the main body 110 to a second end spaced away from the main body 110, and a second portion 120 extending perpendicularly from a first end disposed at the second end of the first portion 118 to a second end that forms a distal end 122 of the retainer 100. As shown FIG. 3A, the second portion 120 is spaced apart from and parallel to the main body 110. The retainer 100 further includes a pair of ribs 124 spaced inwardly from the wings 116 and extending from the top surface 112 of the main body 110 and between the front end 106 and the back end 108 of the retainer 100. Each rib 124 is parallel to and spaced apart from the respective first portion 118 of the adjacent wing 116 and cooperates with the first portion 118 of the adjacent wing 116 to form an engagement surface 126 defining a slot 128 sized to receive a portion of a divider 300 to retain the position of the divider 300 when the merchandising system 10 is assembled.

Figure 4:
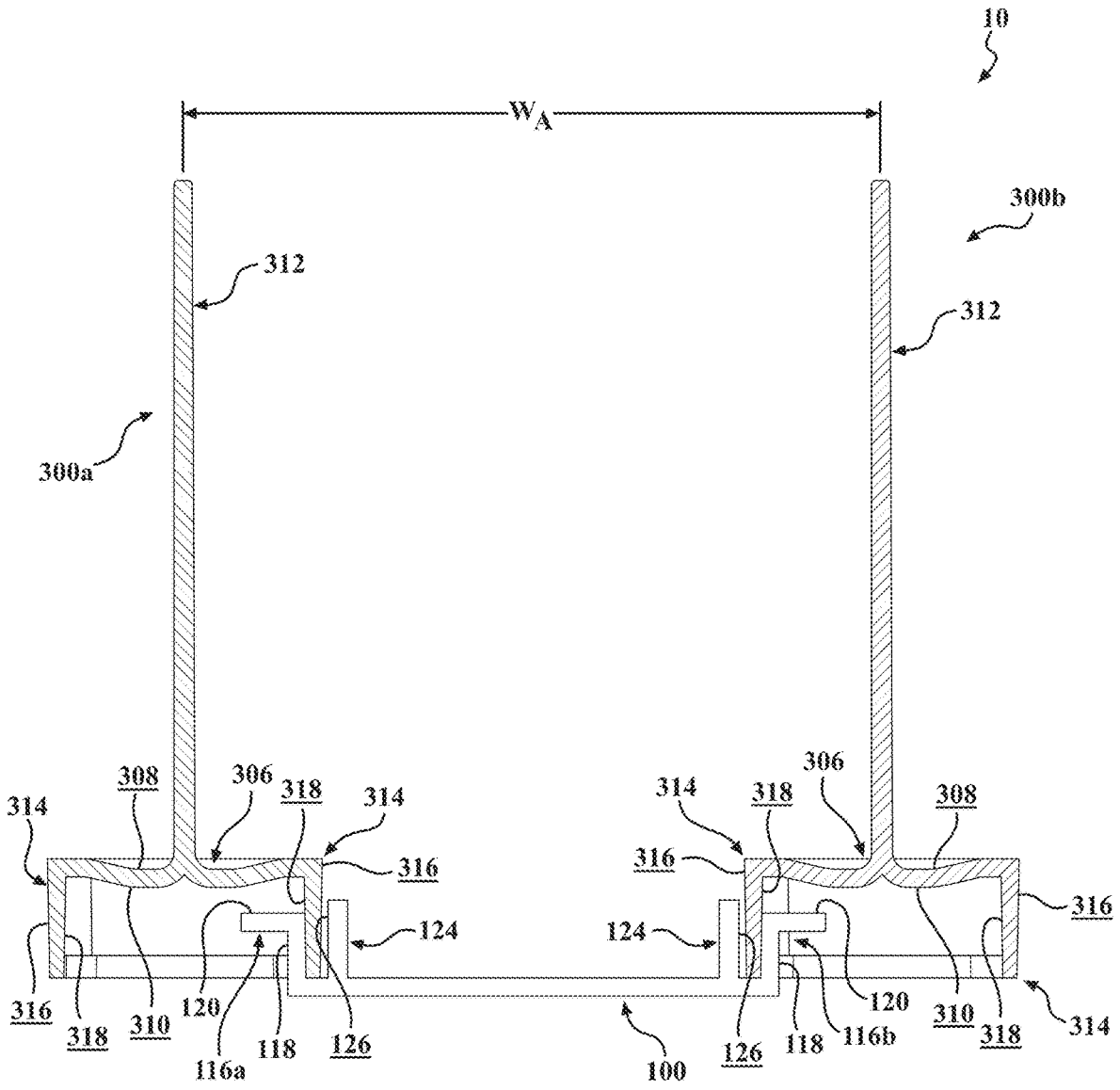
FIG. 4 is a cross-sectional view of the merchandise system of FIG. 1A taken along line 4-4 of FIG. 1A.
Figure 5A:
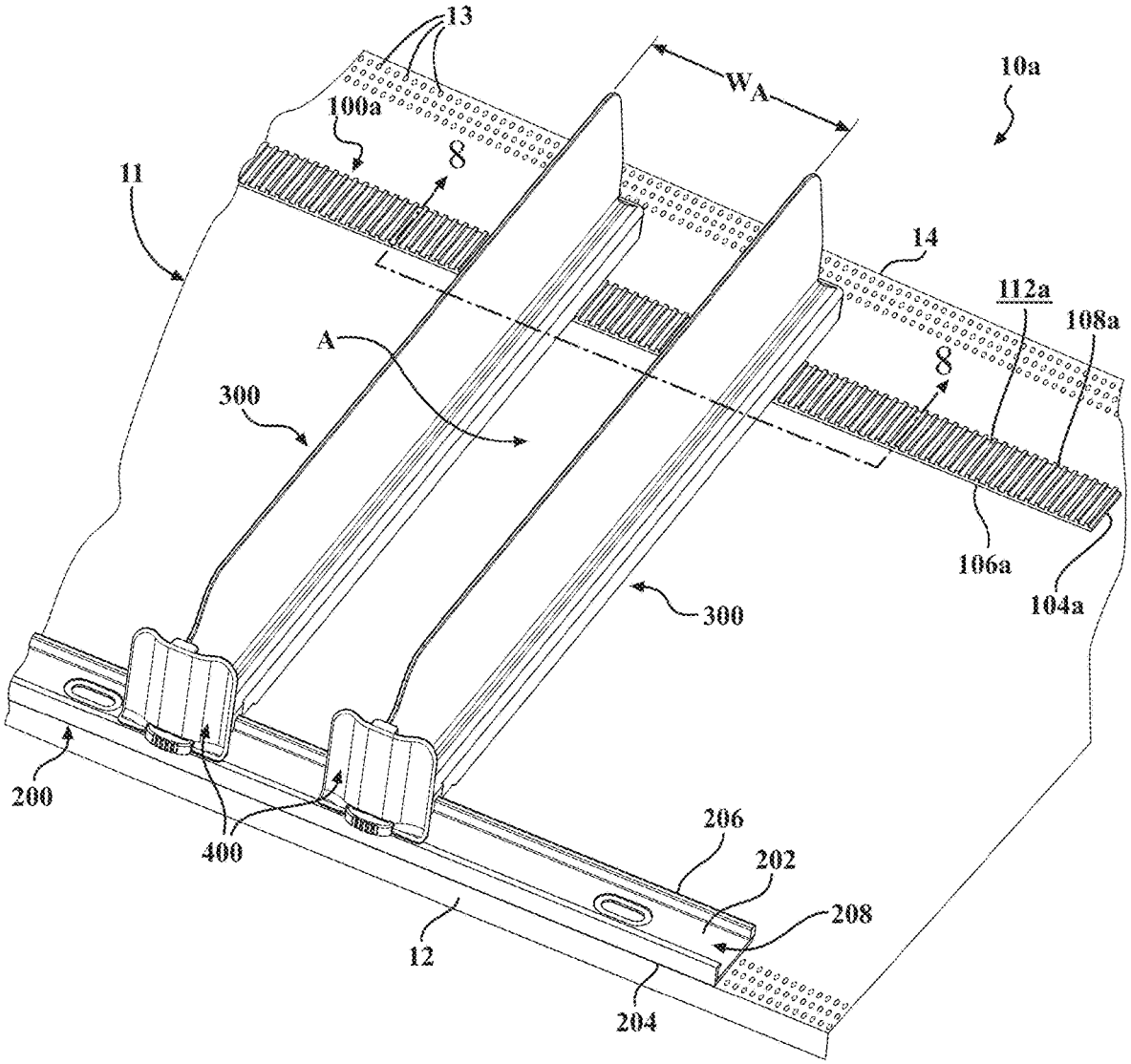
FIG. 5A is a top perspective view of a merchandise system for a retail shelf or other surface according to an example of the present disclosure.
Figure 5B:
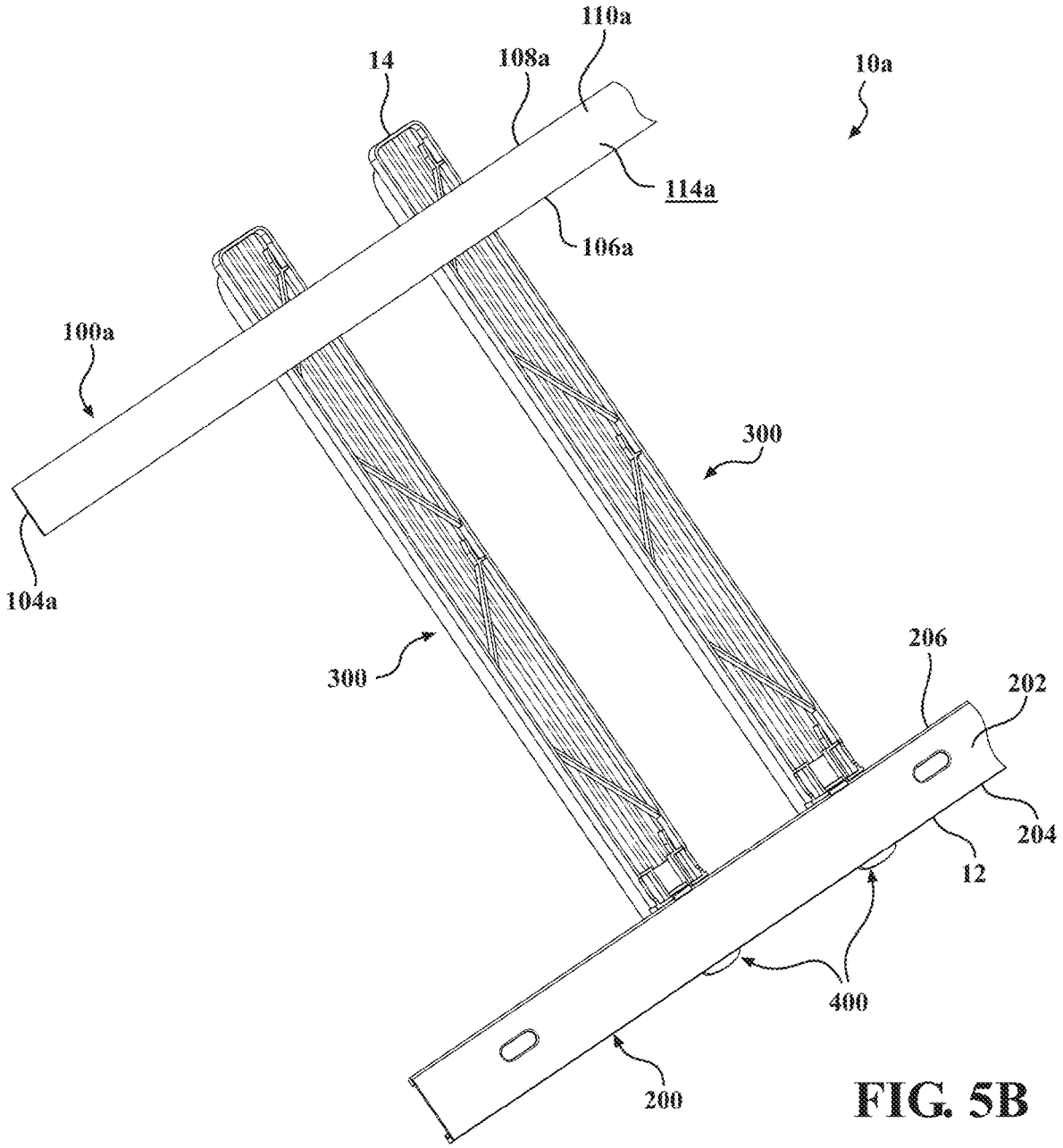
FIG. 5B is a bottom perspective view of the merchandise system of FIG. 5A.
Figure 6:
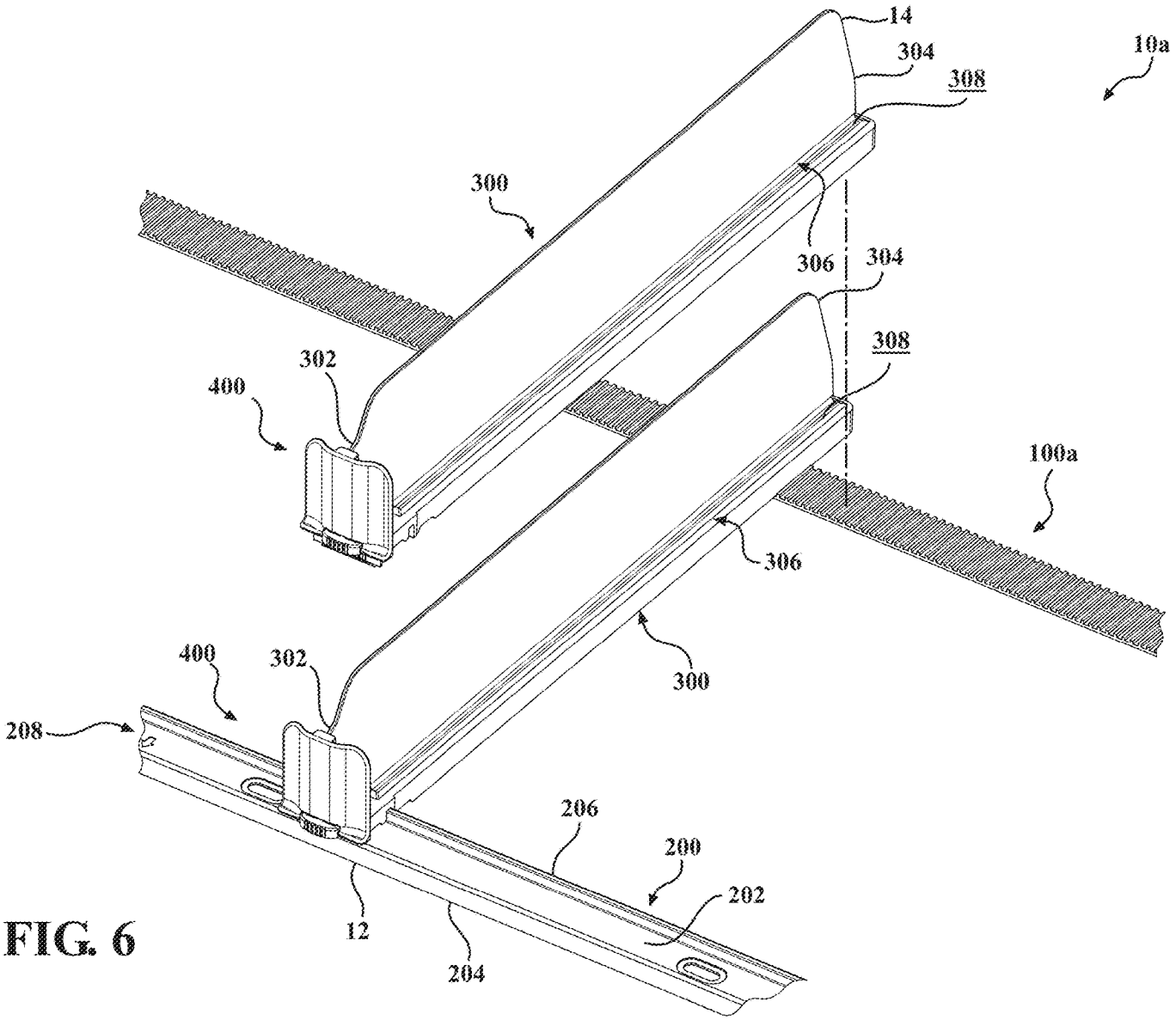
FIG. 6 is a partial exploded top perspective view of the merchandise system of FIG. 5A.
Figure 7A:
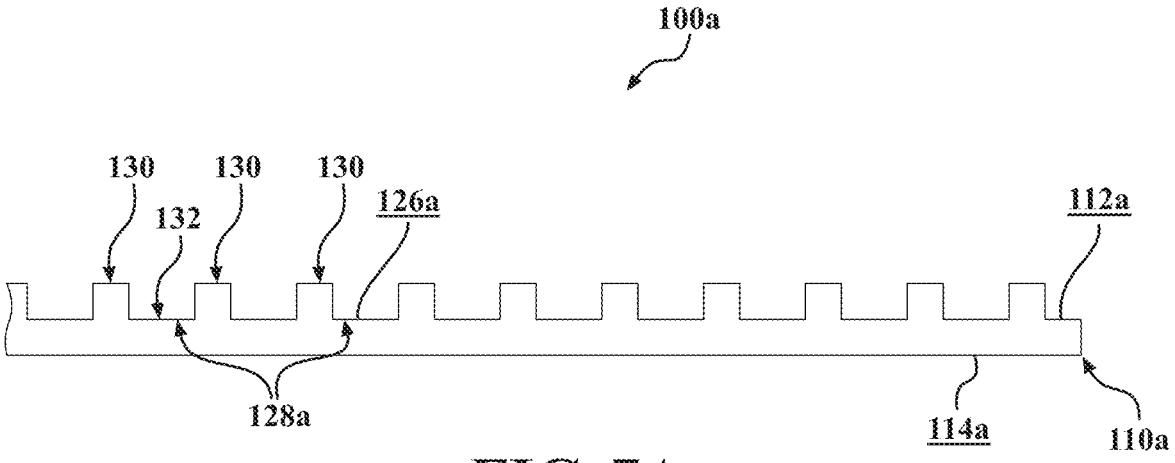
FIG. 7A is a front view of a retainer of the merchandise system of FIG. 5A.
Figure 7B:
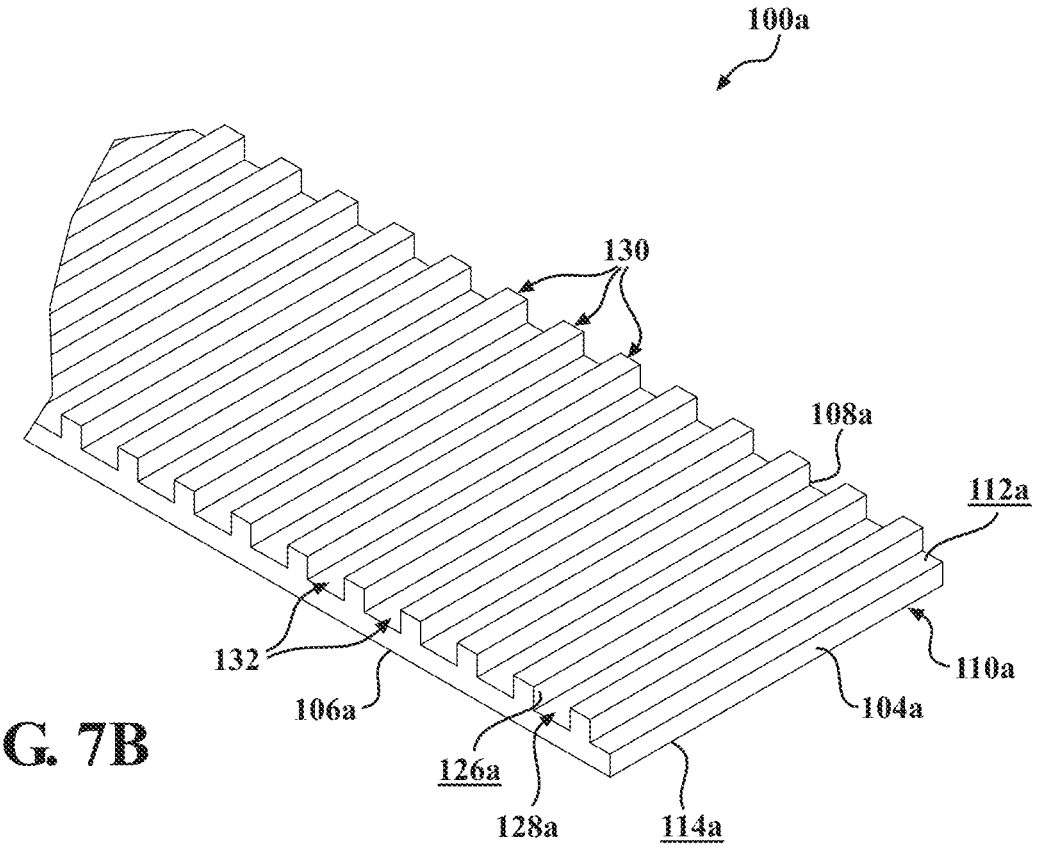
FIG. 7B is a top perspective view of the retainer of FIG. 7A.
Figure 8:
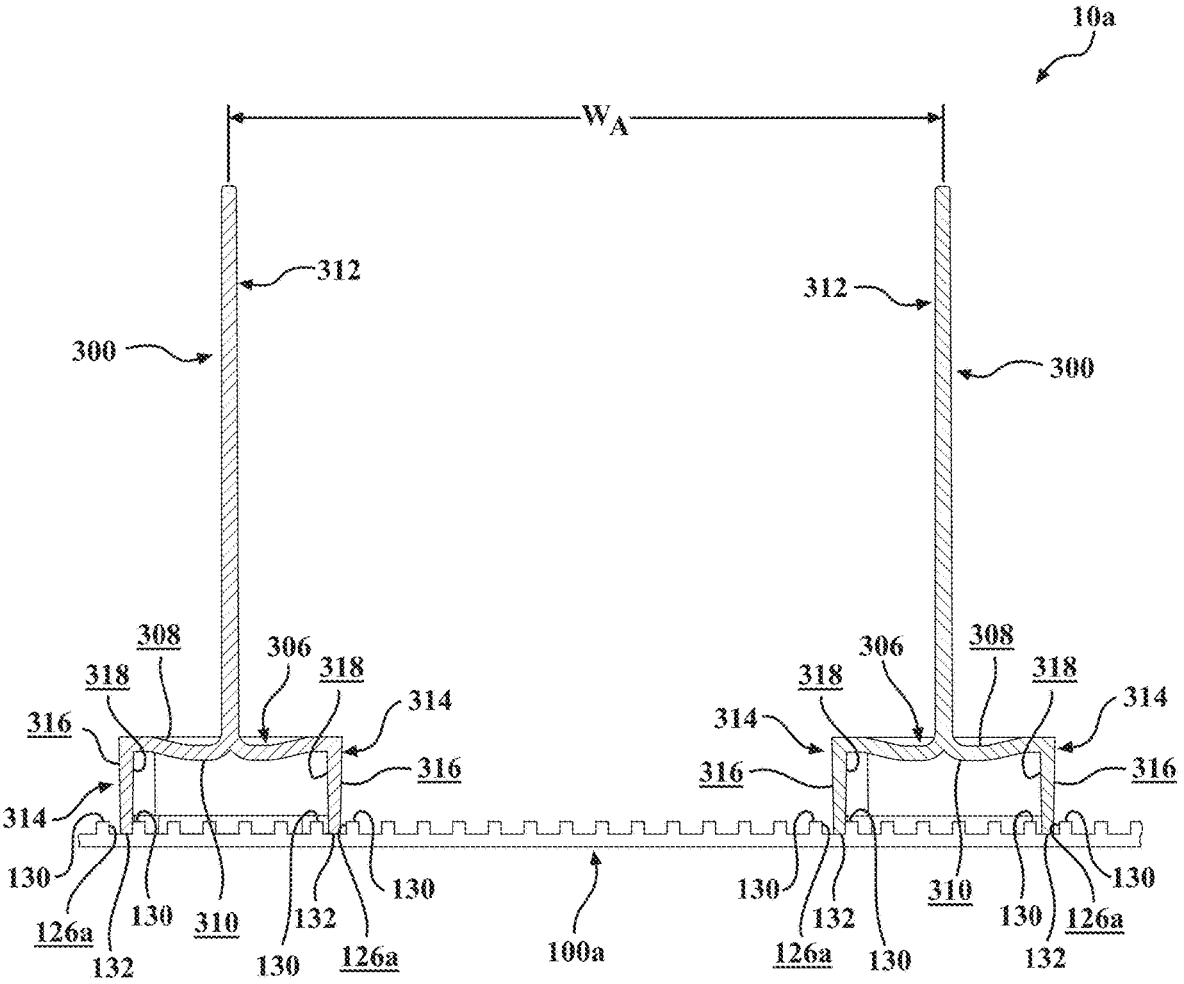
FIG. 8 is a cross-sectional view of the merchandise system of FIG. 7A taken along line 8-8 of FIG. 5A.

Referring to FIGS. 1-8, each divider 300 includes a first end 302, and a second end 304 disposed on an opposite side of the divider 300 than the first end 302, and is defined by a base 306 having an upper surface 308 and a lower surface 310 formed on an opposite side of the base 306 than the upper surface 308. A divider wall 312 extends from the upper surface 308 of the base 306 and longitudinally from the first end 302 to second end 304. As best shown in FIGS. 4 and 8, a width of the base 306 is defined by a pair of parallel sidewalls 314 that each extends from the lower surface 310 of the base 306 and are laterally spaced apart from each other. Each of the sidewalls 314 extends longitudinally from the first end 302 to the second end 304 of the base. Each sidewall 314 includes an outer surface 316 and an inner surface 318 formed on an opposite side of the sidewall 314 than the outer surface 316. When the system 10 is assembled, the divider 300 is retained within the slot 128 of the retainer 100 such that the outer surface 316 of each respective sidewall 314 opposes the first portion 118 of the wing 116, while the inner surface 318 of each respective sidewall 314 opposes the rib 124 of the retainer 100.

With particular reference to FIGS. 1A-2 and 4, when the merchandising system 10 is assembled, the first end 302 of the divider 300 is engaged with the rail 200, while an intermediate portion of the divider 300 between the first end 302 and the second end 304 is selectively engaged within the retainer 100. Specifically, each sidewall 314 is received in a corresponding slot 128 of the retainer 100. Accordingly, the outer surface 316 of the sidewall 314 opposes and engages the engagement surface 126 of the retainer, while the inner surface 318 opposes and engages the first portion 118 of the wing 116.

As shown in FIG. 4, a retainer 100 may be configured to retain adjacent dividers 300*a*, 300*b*. Here, the wings 116*a*, 116*b* of the retainer 100 may retain respective sidewalls 314 of adjacent dividers 300*a*, 300*b*, where the main body 110 of the retainer 100 extends between the sidewalls 314 of adjacent dividers 300*a*, 300*b* and maintains a constant distance between the adjacent dividers 300*a*, 300*b*. By affixing the intermediate portions of adjacent dividers 300*a*, 300*b* to one another via the retainer 100, the dividers 300*a*, 300*b* are maintained in an aligned (i.e., parallel) position and limited from inadvertently splaying or floating laterally along the shelf. Moreover, affixing the intermediate portions of the adjacent dividers 300*a*, 300*b* provide the product receiving area A with a fixed width WA.

With particular reference to FIGS. 5-8, another example of a merchandising system 10*a* is provided and includes a retainer 100*a*, the front rail 200, the one or more dividers 300, and the one or more stop lenses 400. In view of the substantial similarity in structure and function of the components associated with the merchandising system 10*a* with respect to the merchandising system 10, like reference numerals are used hereinafter and in the drawings to identify like components while like reference numerals containing letter extensions are used to identify those components that have been modified.

When the merchandising system 10*a* is installed on a shelf, any suitable merchandise may be positioned within a product receiving area A disposed between adjacent ones of the dividers 300, and behind a stop lens 400. The dividers 300 are selectively positionable along the front rail 200 and extend between the front rail 200 and the retainer 100*a*. When assembled, the retainer 100*a* is operable to secure positions of adjacent dividers 300 relative to one another, thereby preventing the rear ends of the adjacent dividers 300 from splaying or drifting laterally out of alignment (i.e., perpendicular to the front rail 200). Any of the retainer 100*a*, the front rail 200, the divider 300, and the stop lens 400, or portions thereof, may be formed of a known suitable plastic, such as a thermoplastic extrusion, or metal, such as an aluminum extrusion.

Unlike the example of FIGS. 1-4, where each retainer 100 may only adjoin directly adjacent dividers 300, the retainer 100*a* of the present example extends substantially the length of the front rail 200 and may accommodate any number of dividers 300. Here, the retainer 100*a* is defined by a first side 102*a*, a second side 104*a* disposed on an opposite side of the retainer 100*a* than the first side 102*a*, a front end 106*a*, and a back end 108*a* disposed on an opposite side of the retainer 100*a* than the front end 106*a*. The retainer 100*a* includes a main body 110*a* extending between the first side 102*a* and the second side 104*a* and between the front end 106*a* and the back end 108*a*, and is defined by a top surface 112*a* and a bottom surface 114*a* dispose on an opposite side of the main body 110*a* than the top surface 112*a*.

As best shown in FIGS. 7A-8, the main body 110*a* includes a plurality of ribs 130 disposed on the top surface 112*a*. In the illustrated example, each rib 130 in the plurality of ribs 130 extends from the front end 106*a* to the back end 108*a* of the retainer 100*a*, where the plurality of ribs 130 are arranged in series between the first side 102*a* and the second side 104*a* of the retainer 100*a*. The main body 110*a* further includes a plurality of grooves 132 formed between adjacent ones of the ribs 130. Accordingly, each groove 132 extends from the front end 106*a* to the back end 108*a* of the retainer 100*a*. As best shown in FIGS. 7A and 7B, the plurality of ribs 130 and the plurality of grooves 132 alternate in series from the first side 102*a* to the second side 104*a* such that each grooves 132 separates adjacent ones of the ribs 130. Each groove 132 cooperates with the adjacent ribs 130 to form an engagement surface 126*a* defining a slot 128*a* sized to receive a portion of a divider 300 to retain the position of the divider 300 when the merchandising system 10 is assembled.

When the system 10*a* is assembled, the first end 302 of the divider 300 is engaged with the rail 200, while an intermediate portion of the divider 300 between the first end 302 and the second end 304 is selectively engaged within the retainer 100*a*. For example, as shown in FIGS. 5A-8, the second end 304 of the divider 300 is selectively engaged within the retainer 100*a* such that sidewalls 314 are received within respective slots 128*a* of the retainer 100. In particular, the outer surface 316 and the inner surface 318 of sidewalls 314 of the divider 300 engage the engagement surface 126*a* defined by the groove 132 and the adjacent ribs 130 that form the slot 128*a*. As shown, the slot 128*a* is sized to receive the sidewall 314 of the retainer divider 300. By securing the second ends 304 of each divider 300 within the grooves 132 of the retainer 100*a* while the first end 302 is selectively engaged with the rail 200, each divider 300 is maintained in an aligned position and limited from inadvertently shifting laterally along the shelf during use. For example, when merchandise is received between an adjacent pair of the dividers 300 assembled to the system 10*a*, the second ends 304 of adjacent dividers 300 are maintained at a fixed spacing relative to each other via the retainer 100*a*.

This is particularly useful with respect to round or cylindrical merchandise, which may bias outwardly against the dividers 300 when stocked within a product receiving area formed between adjacent dividers 300.

The foregoing examples of the merchandising systems 10, 10*a*, and more particularly, the retainers 100, 100*a* advantageously provide means for maintaining alignment and orientation of the dividers 300 along the top surface of a shelf 11. This is particularly advantageous when the merchandising system 10, 10*a* is stocked with cylindrical or irregularly shaped merchandise, which has a tendency to shift in a lateral direction when biased towards the front edge 12 of the shelf. Thus, to prevent jamming or misalignment of such merchandise, the retainers 100, 100*a* fix the orientation of the dividers 300 to provide product receiving areas A having a fixed width WA.

The terminology used herein is for describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed herein could be termed a second element, component, region, layer or section without departing from the teachings of the example configurations.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A merchandise system for a retail shelf, the merchandise system comprising:

a front rail defining a channel;

a retainer disposed parallel to and spaced apart from the front rail, the retainer including:

a main body, a pair of wings extending from the main body, the wings each having (i) a first portion including a proximal end attached to the main body and a free distal end spaced from the proximal end and (ii) a second portion coupled to the free distal end and extending perpendicular to the first portion, and a pair of ribs spaced inwardly from the wings and cooperating with the first portions to define slots configured to engage one or more dividers; and a first divider having a first end and a second end disposed on an opposite side of the first divider than the first end, the first end configured to selectively engage the channel of the front rail and the second end configured to selectively engage the retainer.

2. The merchandise system of claim 1, wherein the first divider includes a base and a sidewall extending from the base, the sidewall received within one of the slots of the retainer.

3. The merchandise system of claim 1, wherein the first divider extends between and connects the front rail and the retainer.

4. The merchandise system of claim 1, wherein the merchandise system further comprises a second divider parallel to and spaced away from the first divider and having a first end and a second end disposed on an opposite side of the second divider than the first end, the first end of the second divider configured to selectively engage the channel of the front rail and the second end of the second divider configured to selectively engage the retainer.

5. The merchandise system of claim 4, wherein the retainer and the front rail cooperate to maintain a relative alignment between the first divider and the second divider.

6. The merchandise system of claim 4, wherein the main body extends between a first side and a second side, the main body separating the first divider from the second divider.

7. The merchandise system of claim 6, wherein the pair of wings includes a first wing disposed on the first side of the main body and a second wing disposed on the second side of the main body and the pair of ribs includes a first rib disposed on the first side of the main body and a second rib disposed on the second side of the main body.

8. The merchandise system of claim 7, wherein the first wing and the first rib cooperate to form a first slot sized to receive a portion of the first divider, and the second wing and the second rib cooperate to form a second slot sized to receive a portion of the second divider.

9. The merchandise system of claim 7, wherein the first rib is spaced away from the first wing by a first slot, and the second rib is spaced away from the second wing by a second slot.

10. A merchandise system for a retail shelf, the system comprising:

a front rail;

a retainer extending parallel to and spaced apart from the front rail, the retainer including:

a main body, a pair of wings extending from the main body, the wings each having (i) a first portion extending from a proximal end attached to the main body to a distal end spaced from the proximal end and (ii) a second portion extending from the free distal end perpendicular to the first portion, and a pair of ribs spaced inwardly from the wings and cooperating with the first portions to define slots configured to engage one or more dividers; and a first divider having a first end and a second end disposed on an opposite side of the first divider than the first end, the first end configured to selectively engage the front rail and the second end configured to selectively engage the retainer.

11. The merchandise system of claim 10, wherein the first divider includes a base and a sidewall extending from the base, the sidewall received within one of the slots of the retainer.

12. The merchandise system of claim 10, wherein the first divider extends between and connects the front rail and the retainer.

13. The merchandise system of claim 12, wherein the main body extends between a first side and a second side, and the pair of ribs are arranged between the first side and the second side of the main body.

14. The merchandise system of claim 10, wherein the merchandise system further comprises a second divider parallel to and spaced away from the first divider and having a first end and a second end disposed on an opposite side of the second divider than the first end, the first end of the second divider configured to selectively engage the front rail and the second end of the second divider configured to selectively engage the retainer.

15. The merchandise system of claim 14, wherein the retainer and the front rail cooperate to maintain a relative alignment between the first divider and the second divider.

* * * * *